US005200583A

United States Patent [19]

Kupersmith et al.

[11] Patent Number: 5,200,583

[45] Date of Patent: Apr. 6, 1993

[54] ADAPTIVE ELEVATOR SECURITY SYSTEM

[75] Inventors: Bertram F. Kupersmith, Avon; Jannah Stanley, Cromwell; Jeremy B. Kezer; David M. Hughes, both of New Britain, all of Conn.

[73] Assignee: Otis Elevator Company, Farmington, Conn.

[21] Appl. No.: 785,738

[22] Filed: Oct. 31, 1991

[51] Int. Cl.[5] ..... B66B 1/00

[52] U.S. Cl. ..... 187/126; 187/121; 381/42

[58] Field of Search ..... 187/121, 126; 381/42

[56] References Cited

U.S. PATENT DOCUMENTS

| | | | |
|---|---|---|---|
| 4,157,133 | 6/1979 | Corcoran et al. | 187/126 |
| 4,341,288 | 7/1982 | Bass | 187/126 |
| 4,449,189 | 5/1984 | Feix et al. | 381/42 |
| 4,534,056 | 8/1985 | Feilchenfeld et al. | 381/42 |
| 4,655,324 | 4/1987 | Meguerdichian et al. | 187/121 |

*Primary Examiner*—Steven L. Stephan
*Assistant Examiner*—Thomas M. Dougherty

[57] ABSTRACT

An adaptive elevator security system has a security module (52) which uses data stored in a configuration data element (64) to update a security state data element (62). The security module (52) provides data from a raw car/hall call data element (56) to a filtered car/hall call data element (58) according to data stored in the security state data element (62).

5 Claims, 2 Drawing Sheets

80

| FIELDS | TYPE OF INPUT (82) | DEFAULT OPERATION (83) | FLOORS AFFECTED (84) | ELEVATORS AFFECTED (85) | TYPE OF SERVICE TO FLOORS (86) | ACTIVE ON OR OFF (87) | INTERACTION OF MULTIPLE FEATURES (88) | OUTPUT MESSAGE (89) |
|---|---|---|---|---|---|---|---|---|
| DESCRIPTION | E.G. KEY, MAG CARD READER, CLOCK, REMOTE LINK, ETC. | OPERATION OF SECURITY SYSTEM WHEN INPUT FAILS | WHICH FLOORS ARE AFFECTED BY THE SECURITY INPUT | WHICH ELEVATORS ARE AFFECTED BY THE SECURITY INPUT | E.G. CAR CALLS ONLY, HALL CALLS, ONLY, BOTH, NEITHER, ETC. | DOES INPUT GRANT OR DENY ACCESS | ANDING, ORING, AND COMBINATIONS THEREOF | USER MESSAGE |

FIG. 3

ADAPTIVE ELEVATOR SECURITY SYSTEM

TECHNICAL FIELD

This invention relates to the field of elevator security systems.

BACKGROUND ART

An elevator security system controls elevator car access to various floors by controlling the servicing of certain car calls and/or hall calls, which are only serviced at certain times or in response to actuation of a security peripheral device, such as a key or a magnetic card reader. Many times, the access for an entire group of elevators is controlled by actuation of security peripheral devices in only one elevator of the group.

The specifics of an elevator security system (i.e. which hall and/or car calls are serviced under which conditions) depend upon individual needs at a particular building, thereby necessitating the use of unique, customized security software at each site. This not only increases the initial cost of the security software, but also increases the cost and difficulty of maintaining and updating all of the elevator control software.

DISCLOSURE OF INVENTION

Objects of the invention include an elevator security system which can be customized to individual needs without modifying elevator control hardware or software.

According to the present invention, an elevator security system uses a configuration table having data therein indicative of the identity of security peripheral devices hall calls and car calls affected by the security system, floors affected by the security system, and elevators affected by the security.

According further to the invention, the configuration table may also have data indicative of default operations, data indicative of messages which may be displayed, data indicative of interaction of peripherals, and data indicative of whether access should be blocked with the peripheral actuated ON or actuated OFF.

The foregoing and other objects, features and advantages of the present invention will become more apparent in light of the following detailed description of exemplary embodiments thereof, as illustrated in the accompanying drawings.

BRIEF DESCRIPTION OF DRAWINGS

FIG. 3 is a chart indicating the format and purpose of fields in an elevator security configuration table.

Best Mode for Carrying Out the Invention

Figure 1:
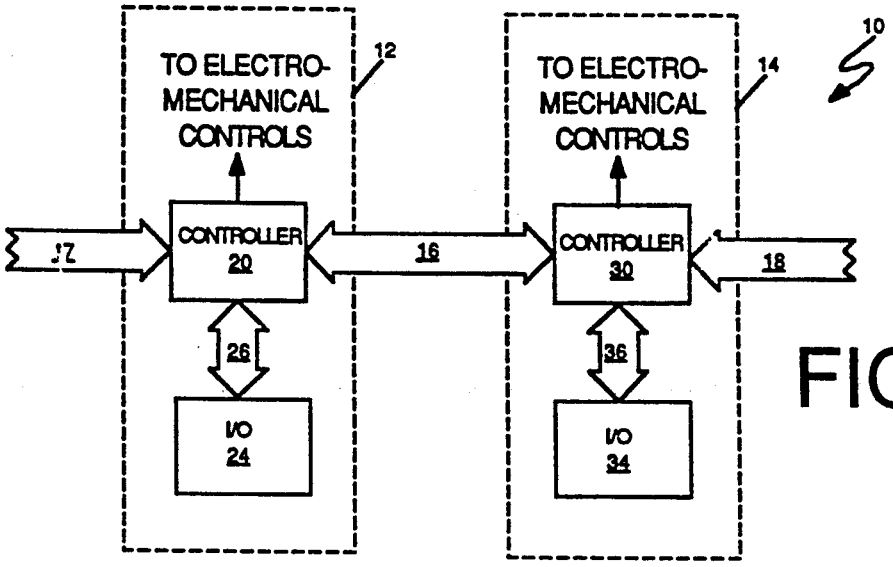
FIG. 1 is a schematic block diagram of an elevator group.

Referring to FIG. 1, an elevator group 10 is comprised of a first elevator 12 and a second elevator 14. Digital communication between the elevators 12, 14 is provided by an interelevator communication link 16, which is implemented by means known to those skilled in the art. The group 10 may also be comprised of other elevators (not shown) which communicate with the first and second elevators 12, 14 via other interelevator communication links 17, 18. A remote elevator communications interface (not shown), which provides for interfacing the group 10 with a remote computer, may also be used.

The first elevator 12 is comprised of a microprocessor-based controller 20 which provides signals to electromechanical controls (not shown) for actuating electromechanical devices (not shown) that move an elevator car (not shown). The controller 20 also sends and receives signals to and from elevator input/output devices 24, such as hall and car call buttons, hall lanterns, floor indicators, etc. via an intraelevator communications link 26, the implementation of which is known to those skilled in the art. The second elevator 14 is similarly configured with a microprocessor based controller 30, input/output devices 34, and an intraelevator communications link 36.

Elevator security is implemented using a combination of software (embedded in the controllers 20, 30) and elevator security peripherals, known to those skilled in the art, such as a magnetic card reader, a key, or a clock (to control access to floors as a function of time). The security are part of the input/output devices 24, 34. A remote elevator communications interface, known to those skilled in the art, may also act as a security peripheral. The controllers 20, 30 receive input signals from the security peripherals.

The cost of implementing the security system can be reduced by designating one elevator of the group 10 a security master and all other elevators of the group 10 security slaves. Signals indicative of the security state of the system are transmitted from the master to the slaves via the interelevator links 16–18, thereby allowing slaves to have the same security as the master. Cost is reduced by eliminating the need to install communications between security peripherals and controllers of elevators which will only be slaves. The master/slave designation is provided by a switchover module, which is part of the interelevator communication links 16–18 and is known to those skilled in the art.

Figure 2:
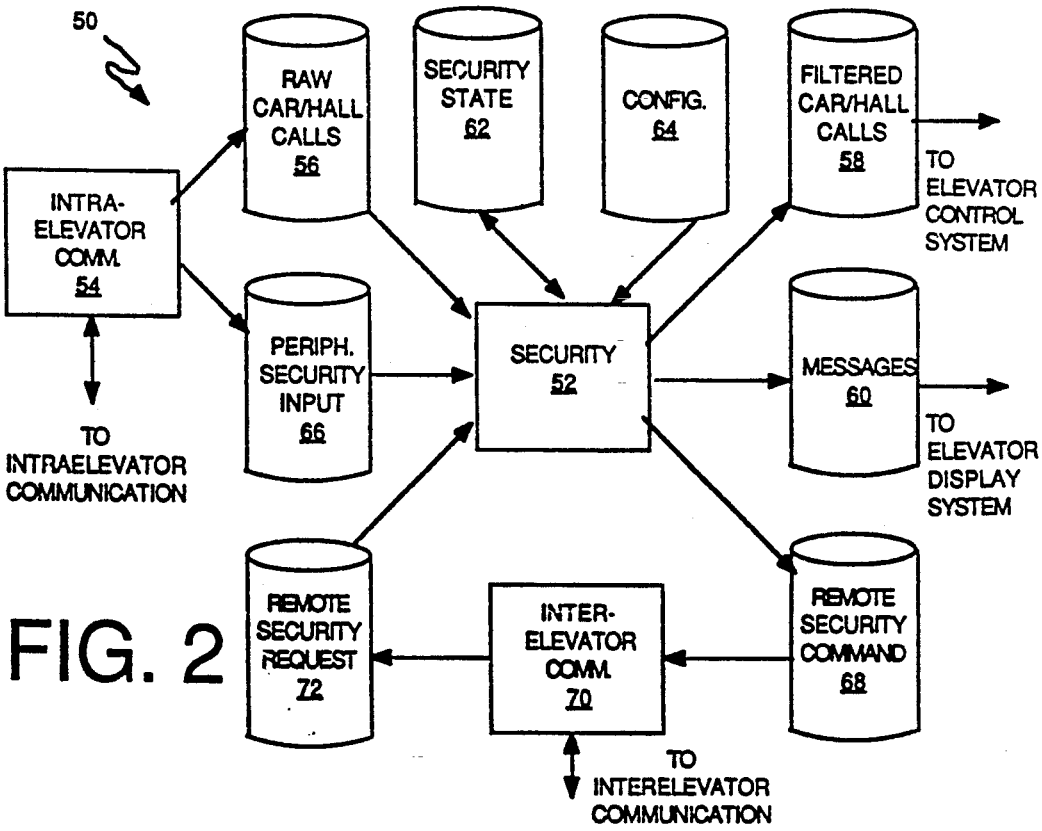
FIG. 2 is a software dataflow diagram illustrating operation of a security system according to the invention.

Referring to FIG. 2, a dataflow diagram 50 illustrates operation of elevator controller software which is embedded in ROMs (not shown) and executed by microprocessors (not shown) which are part of the controllers 20, 30 for each elevator. Boxes on the diagram 50 indicate program modules (portions of the elevator controller software) while cylinders indicate data elements (portions of elevator controller data). Arrows between boxes and cylinders indicate the direction of the flow of data. Unlike a flowchart, no portion of the dataflow diagram 50 indicates any temporal relationships between the various modules.

A security module 52 controls elevator car access to various floors. A hall or car call signal is received by the elevator controller software via an intraelevator communications module 54, which process input from the intraelevator communications link 26. Digital data indicative of the particular call is stored in a raw car/hall call data element 56, which is provided as an input to the security module 52.

If the security state of the system indicates that a particular call, including direction (up or down) of a hall call, can be serviced, the security module 52 writes the data from the raw car/hall calls data element 56 to a filtered car/hall calls data element 58. A signal indicative of the data stored in the filtered car/hall calls data element 58 is provided to elevator control system software (not shown) which provides signals to actuate the elevator electromechanical controls to move the car to service the call.

If the security state of the system indicates that a call stored in the raw car/hall calls data element 56 should not be serviced, the security module 52 does not write anything to the filtered car/hall calls data element 58 but may, instead, write a message to a messages data element 60. The message could explain to a user why a particular car or hall call cannot be serviced. A signal indicative of the data from the messages data element 60 is provided to elevator display system software (not shown) which causes the message to be displayed.

The security module 52 determines whether a call should be serviced by examining data in a security state data element 62 (which may be in a RAM of each of the controllers 20, 30) which contains a state table having a plurality of wherein each member corresponds to a floor and wherein the data for each member indicates whether hall calls and/or car calls for the corresponding floor can be serviced. When data indicative of a call has been placed in the raw car/hall calls data element 56, the security module 52 examines the appropriate member in the security state data element 62. The security module 52 then uses the data associated therewith to determine whether or not to provide the call to the filtered car/hall calls data element 58 (i.e. whether or not to allow the call).

The state table in the security state data element 62 is initialized (in the master elevator), by the security module 52 at power-up with a configuration table. The configuration table is stored in a ROM and is provided by a configuration data element 64. If an elevator is a security master, changes in the security state itself are provided by sec signals which indicate actuation (scanning ON or OFF) of one or more security peripherals (peripheral devices), such as a card reader, a key, a clock, or a remote elevator communicatons interface (e.g., part of an elevator management system). Data indicated for the security signals is provided to the controller software via the intraelevator communications. module 54, which stores the data in a peripheral security input data element 66. The security module 52 reads the peripheral security input data element 66 and updates the security state data element 62 which also contains the configuration table, described in more detail hereinafter, stored in a ROM and provided by the configuration data element 64.

An elevator that is a security master also transmits security state information to slave elevators. The security module 52 writes the security state table (from the security state data element 62) to a remote security command data element 68. An interelevator communications module 70 provides signals indicative of the data from the remote security command data element 68 to the slave elevators via appropriate ones of the interelevator communication links 16–18.

For an elevator that is a security slave, the interelevator communications module 70 receives signals indicative of the state of the security system (over one of the interelevator communication links 16–18) and stores the information in a remote security request data element 72. The security module 52 updates the security state data element 62 with data from the remote security request data element 72. An elevator that is a slave ignores data that may be stored in the peripheral security input data element 66.

Referring to FIG. 3, a chart 80 indicates the format and purpose of a plurality of fields 82–89 associated with each entry of the configuration table stored in the configuration data element 64. Each entry of the configuration table corresponds to a unique security function. For example, a key that controls car call access to some floors and car a hall call access to other floors will correspond to at least two entries in the table.

When a security signal from a security peripheral is received the security module 52 52 examines the configuration table in the configuration data element 64 in order to determine the changes, if any, to be made to the security state 62 of the group. Note that a security slave will not receive security signals from peripherals and does not access the configuration data element 64 but will instead receive security state information from a security master.

The first field 82 indicates the source of an input associated with an entry. The security module 52 uses this field to associate a particular table entry with a particular security peripheral device. Thee will be one or more entries associated with each peripheral device. The second field 83 indicates the default operation of the security system when there is a failure related to the security peripheral associated with the entry, a condition which can occur when the peripheral fails or when communication between the peripheral and the controller fails. The possible options include continuing the present security state, changing the state to the power-up security state, denying access to all secured floors related to such peripheral, allowing access to all secured floors, etc.

The third field 84 indicates which floors are affected by the associated security peripheral. In a preferred embodiment, each entry relates to only one floor; a peripheral device which is to affect the same function on several floors requires several entries. The fourth field 85 indicates which elevators of the group are affected by the associated security peripheral. The fifth field 86 indicates the type of service that is affected by the security peripheral. The security peripheral may only affect car calls, hall calls, calls (up or down, both (or all) VIP calls, etc. The sixth field 87 indicates the effect of the state of actuation of the security peripheral; that is, whether the security signal from the peripheral is act the ON state or OFF state, i.e. indicates whether receipt of the security signal grants or denies access.

The seventh field 88 indicates the interaction of multiple security peripherals. It is possible for access to a particular floor to be controlled by two security peripherals simultaneously so that, for example, a car call to a floor is serviced only if security signals from both a key and a magnetic card reader are received. The eighth field 89 indicates an output message which is provided to indicate that a specific security restriction is active.

Even though the invention is il herein with a security master elevator controlling the security state of a plurality of security slave elevators, it is to be understood by those skilled in the art that the invention may be practiced without making a master/slave distinction between elevators in a group (i.e. by providing every elevator with communication between it and the security peripherals which control that elevator). The invention may be practiced even if the names, order, descriptions, etc. of the fields of the configuration table are modified.

Portions of the processing illustrated herein may be implemented instead with electronic hardware, which would be straightforward in view of the hardware/software equivalence discussed (in another field) in U.S.

Pat. No. 4,294,162 entitled "Force Feel Actuator Fault Detection with Directional Threshold" (Fowler et al.). Instead of reading and writing data to and from data elements, the hardware would communicate by receiving and sending electronic signals.

Although the invention has been shown and described with respect to exemplary embodiments thereof, it should be understood by those skilled in the art that various changes, omissions and additions may be made therein and thereto, without departing from the spirit and the scope of the invention.

What is claimed is:

1. A method of providing secure service to an elevator system in a building, comprising:

providing a plurality of configuration signals indicative of a table of entries, each entry including a field identifying a particular security peripheral device which may be actuated to affect access to use of the elevator system, a field identifying a floor of the building, the access to which is to be affected by actuation of the related peripheral device, a field identifying an electro car involved in the affected access of said entry and a field indicating whether said entry is effective or not to deny access in response to car calls, up hall calls or down hall calls, receptively;

providing, in response to actuation of a security peripheral device, a security input signal indicative of such security peripheral device having been actuated;

providing, in response to said configuration signals and said security input signal, a plurality of security state signals separately indicative of any floors to which access is to be denied from any specific elevator car, any floors from which access si to be denied to any specific elevator car traveling in the up direction, and any floors from which access is to be denied to any specific elevator car reveling in the down direction;

providing, in response to actuation of hall call buttons and car calls buttons, corresponding raw hall call signals and raw car call signals; 'and providing to said elevator system, filtered hall call signals and filtered car call signal each corresponding to a related one of said raw hall call signals and said raw car call signals relating to service not involving access which is indicated by said security state signals as access to be denied.

2. A method according to claim 1, wherein each entry includes a field indicating whether said security state signals should indicate access is to be denied in response to said corresponding particular security peripheral device being actuated ON or actuated OFF.

3. A method according to claim 1 wherein each entry includes a field indicating a default operation with respect to said entry to become effective in the event that is becomes impossible to provide said security input signal in response to actuation of the corresponding device.

4. A method according to claim 1 wherein each entry includes a field indicating a corresponding message to be displayed in relation to said entry.

5. A method according to claim 1 wherein each entry includes a field indicating interaction with another security peripheral device and the actuation condition thereof which affects the access related to said entry.

* * * * *